US009555993B2

(12) United States Patent
Rennebod

(10) Patent No.: US 9,555,993 B2
(45) Date of Patent: Jan. 31, 2017

(54) WINDING APPARATUS FOR WINDING A WEB INTO A ROLL

(71) Applicant: Jesco Holding ApS, Odense NØ (DK)

(72) Inventor: Jes Bo Rennebod, Odense NØ (DK)

(73) Assignee: Jesco Holding A/S, Odense NØ (DK)

( * ) Notice: Subject to any disclaimer, the term of this patent is extended or adjusted under 35 U.S.C. 154(b) by 187 days.

(21) Appl. No.: 14/395,607

(22) PCT Filed: Apr. 18, 2013

(86) PCT No.: PCT/DK2013/050112
§ 371 (c)(1),
(2) Date: Oct. 20, 2014

(87) PCT Pub. No.: WO2013/156036
PCT Pub. Date: Oct. 24, 2013

(65) Prior Publication Data

US 2015/0076276 A1 Mar. 19, 2015

(30) Foreign Application Priority Data

Apr. 18, 2012 (DK) ..... PA 2012 70198

(51) Int. Cl.
*B65H 19/28* (2006.01)
*B65H 19/22* (2006.01)

(52) U.S. Cl.
CPC ..... *B65H 19/28* (2013.01); *B65H 19/2238* (2013.01); *B65H 2301/5151* (2013.01); *B65H 2301/51532* (2013.01); *B65H 2301/51533* (2013.01); *B65H 2406/122* (2013.01);
(Continued)

(58) Field of Classification Search
CPC ..... B65H 19/28; B65H 2301/5153; B65H 2406/31
See application file for complete search history.

(56) References Cited

U.S. PATENT DOCUMENTS 4,147,287 A 4/1979 Reba
4,695,004 A * 9/1987 Grossmann ..... B65H 19/265 242/526.3
4,798,351 A 1/1989 Halter et al.
(Continued)

FOREIGN PATENT DOCUMENTS

DK 146684 B 12/1983
EP 0 183 135 A1 6/1986
(Continued)

*Primary Examiner* — Sang Kim
(74) *Attorney, Agent, or Firm* — David S. Safran

(57) ABSTRACT

A winding apparatus for winding a web material onto an empty core and into a roll, having a winding drum for guiding the web material supported on a first side, and cutting device for cross-cutting the web material prior to winding of it onto an empty core. The winding apparatus has air nozzles for ejecting compressed air onto the first side of the web material near a free end of the web material. By ejecting a gas, which preferably could be compressed air, onto the free end of the web, the free end is blown towards the empty core which is rotated. When the free end of the web material comes into contact with the rotating empty core, due to the ejected gas/air, the web will easily be "caught" by the rotating empty core, even without tape or adhesive, and a smooth new roll of web material wound.

8 Claims, 6 Drawing Sheets

(52) U.S. Cl.
CPC .. *B65H 2406/15* (2013.01); *B65H 2406/3432* (2013.01); *B65H 2408/236* (2013.01)

(56) References Cited

U.S. PATENT DOCUMENTS

| | | | | |
|---|---|---|---|---|
| 5,577,685 | A | 11/1996 | Junk | |
| 6,332,587 | B1 | 12/2001 | Möller et al. | |
| 6,581,868 | B1 | 6/2003 | Enwald et al. | |
| 6,705,560 | B1 * | 3/2004 | Rågård | B65H 19/267 156/172 |
| 6,752,348 | B2 | 6/2004 | Dreckmann et al. | |
| 2006/0032966 | A1 * | 2/2006 | Perini | B65H 19/2261 242/532.2 |

FOREIGN PATENT DOCUMENTS

| | | | |
|---|---|---|---|
| EP | 0 994 058 | A1 | 4/2000 |
| GB | 1 190 850 | | 5/1970 |
| JP | 2002-362798 | A | 12/2002 |
| WO | 99/28227 | A1 | 6/1999 |

* cited by examiner

WINDING APPARATUS FOR WINDING A WEB INTO A ROLL

BACKGROUND OF THE INVENTION

Field of the Invention

The present invention relates to a winding apparatus suitable for winding a web material, comprising a first and a second side and a free end, onto an empty core and into a roll, the winding apparatus comprising a winding drum for guiding the web material by supporting it on the first side, and further comprises cutting means for cross-cutting the web material prior to it being wound onto an empty core. The winding apparatus also comprises means for moving the empty core from a first position to a second position comprising a set of retainer arms for carrying and moving the core from the first position to the second position near the periphery of the winding drum while web material is being wound onto the core, and for carrying at least one roller that is arranged to lift the web material from the winding drum, during winding, prior to cross-cutting said web material along said roller and thus creating said free end of web material.

Description of Related Art

It is well known to wind different types of webs, e.g., plastic foil or film, paper and other types onto a center roll—a core—made from, e.g., metal, plastic or paper. Also, a core bar, a winding shaft or the like can be used, but in the following text the term "core" will be used as a common term for all the different types of cores and shafts. Such winding processes are performed with high speed, and when one roll is full, the web has to be cut and guided to a new and empty core. In order to attach the web to the core, it is common to add an adhesive to the surface of the roll, for example, either as a hot melt adhesive or preferably as a tape that is attached to the cores and also has an adhesive side facing the web that has to be wound. Web material will typically be wound onto a core during production, and e.g., plastic foil or film will be produced using an extruder and the foil or film will be wound immediately after it leaves the extruder. However, it is common to cut the foil or film into specific widths prior to winding it.

Hot melt or other types of adhesives have a number of drawbacks that make alternative solutions attractive. First of all, it can be difficult to control the hot melt and often the hot melt adhesive will/can be absorbed into the web, and then, several layers of the web material are glued together so as to be of no use, and therefore, must be considered as waste. This is also a known problem when using other types of adhesive. Further, a foil or film that has been glued to the core can block the equipment where the web is being unwound since, if the web sticks to the core, the web might burst which might lead to the equipment being jammed or even damaged by several layers of web material and adhesive being pulled into the equipment.

Another solution that is very common is to add an adhesive tape—often a polypropylene tape—to the core. It is then possible to attach the web to the core when winding the web onto the core, but the tape solution also offers a number of drawbacks. When a roll of web material is empty, the tape can have a tendency to be so strong that the web is broken or torn, thus exerting some unwanted forces onto the equipment. Further, the tape on the core tends to be pulled off from the core and to continue into the apparatus where the web material is processed. This is highly unwanted as the tape may easily damage or require the machinery to be stopped for either cleaning or repair. The tape is, as mentioned, normally made from polypropylene and is not recyclable unlike the paper core and this is another drawback. The tape also has the drawback that the innermost of the layers on the core often will be irregular or even bumpy due to the thickness of the tape. The tape can even have an overall influence on the regularity of the complete roll. If, e.g., a roll of thin plastic film does not have a very even and circular shape, the complete roll can only be sold as a second grade roll, which of course has a negative impact on the price. Adding the tape to a typical paper core is further time consuming and, as a consequence, also expensive.

It is thus very important to be able to wind web material onto a core without the need for adding tape to the core and preferably without use of any other processes that will prevent the web from being unwound until the very last centimeter and without creating a huge amount of waste, and especially waste which is not recyclable.

None of the above known solutions address the above problems, and so far the problem might have been realized, but no solution is given.

SUMMARY OF THE INVENTION

It is an object of the present invention to provide a solution to the above indicated problems that allows winding of a web onto a core without the need for adhesive tape and/or hot melt adhesive on the surface of the core, where a winding process does not need to be stopped during change of the roll/core, and where the web material is guided to a perfect contact with the core.

It is a further object of the invention to provide a solution for winding a roll of web material that will allow a subsequent process, where the web material is unwound and used, to take place without the risk of the process being stopped or blocked by the web material, hot melt or tape blocking the unwinding or being pulled into the equipment performing said process.

As mentioned above, the invention relates to a winding apparatus suitable for winding a web material, comprising a first and a second side and a free end onto an empty core and into a roll, the winding apparatus comprising a winding drum for guiding the web material by supporting it on the first side, and further comprises cutting means for cross-cutting the web material prior to wounding it onto an empty core, the winding apparatus further comprising means for moving an empty core from a first position to a second position with a set of retainer arms for carrying and moving said core from the first position to the second position near the periphery of the winding drum while web material is being wound onto said core, and for carrying at least one roller and that arranged to lift the web material from the winding drum, during winding, prior to cross-cutting the web material along the roller, and thus, creating the free end of web material.

The web material to be handled by the winding apparatus according to the invention can be a paper web, but mainly webs of plastic, such as webs for producing plastic shopping bags and other types of bags, foils for wrapping boxes with goods prior to shipping the boxes, for wrapping up hay and the like. Such webs pose some problems/challenges that are overcome by the present invention.

A winding apparatus according to the present invention comprises nozzle means for ejecting a gas, e.g., compressed air, onto the first side of said web material near its free end. By ejecting a gas, which preferably could be compressed air, onto the free end of the web, the free end is blown towards the empty core which is rotating. When the free end of the web material comes into contact with the rotating empty core, due to the ejected gas/air, the web will easily be "caught" by the rotating empty core, even without tape or adhesive, and a smooth new roll of web material is winded. It is very important that the start of a new roll of web material is smooth as even a small bump on the core will have a negative influence on the quality and the possible price of the entire roll of web material.

In an embodiment of a winding apparatus according to the invention, the nozzle means comprises a crossbar extending substantially in parallel with the winding drum. The crossbar comprises a number of nozzles which are distributed across the entire length of the cross bar, the nozzles being directed toward the first side of the web material.

The crossbar, also called an air bar, is preferably a stationary bar with a low friction surface, but in principle, it can also be a rotatable bar that rotates due to friction when in contact with the web or by appropriate drive means, e.g., an electric motor. The low friction surface can be made of any suitable material, e.g., a coating of polytetrafluorethylene (PTFE), e.g., TEFLON®. The crossbar extends across the web material and lifts the web material from the surface of the winding drum and when gas/air is ejected through the nozzles, the web material is forced away from the surface of the crossbar as a kind of air cushion is established between the crossbar and the web material. When the web material is cut along the winding drum, i.e., across the web, the free end of the web material will be blown towards the core and start being wound around the rotating core.

A winding apparatus according to the invention is special in that it comprises a crossbar that is hollow and comprises at least two internal compartments that extend along the length of the crossbar. By having at least two longitudinal compartments in the crossbar, e.g., an extruded aluminum profile with one or more internal walls, the nozzles can be arranged along the air bar in rows and with a suitable distance in the length direction and/or in the circumferential direction. If the nozzles are arranged, in e.g., two rows and with a lengthwise distance of 100 to 250 millimeters and with a diameter of e.g., 2 millimeters, a very good effect is obtained. Other sizes and distances will of course be possible, and the pressure can also be altered or adjusted to fulfill the needs.

By arranging the nozzles in, e.g., two rows, where one row is in connection with one compartment and where a second row connected with a second compartment, the two sets of nozzles can be supplied with a different flow of gas so as to allow for an individual exposure of the effect from the nozzles towards the web. The pressure as well as the timing of when the nozzles are active can be differentiated in various compartments. One set of nozzles can, e.g., be active before and during cutting of the web, and a second set of nozzles can be activated in the same moment as the cutting takes place. And by having even more sets of nozzles, even further combinations can be used to secure a quick, efficient and a high quality change of core.

It is to be understood that a crossbar according to the invention also can comprise only one compartment, but also more than one or two of said compartments.

A winding apparatus according to the invention can comprise further nozzle means that are also directed toward the first side of the web material and arranged along the winding drum. The further nozzle means can, e.g., be installed on the cutting means or on the retainer means that hold the empty core and the crossbar. Such further nozzles can also be arranged to eject gas/air towards the web to assist the nozzles in the crossbar.

In an embodiment of a winding apparatus according to the invention, the cutting means comprises a knife unit having nozzle means for ejecting gas, e.g., compressed air toward the first side of the web material while cutting the web material. By having one or more nozzles arranged directly on the knife unit, it becomes possible to exert a force on the free end of said web material even before the cut is performed. Such nozzle means can, e.g., be arranged directly in the cutting means, so that gas can be ejected directly at the cutting place. By exerting this force onto the web material, a very controlled movement or transfer of the free end towards the core will be performed, which allows for a perfect start on a new roll of web material.

The cutting means may comprise a mechanism that allows the knife unit to be moved along the winding drum while in contact with the web material. The mechanism comprises, e.g., a pneumatic actuator, or other means for moving the cutting means across the web material. The cutting of the web is performed while winding and as the web is moved rather quickly, the cutting process has to be performed at high speed.

A winding apparatus according to the invention where the cutting means comprise a knife unit, and further comprises a stationary crossbar, e.g., a crossbar with nozzles, the crossbar having a recess in the longitudinal direction, in which at least a part of the knife unit is moved, is advantageous. Preferably, the knife unit is actually driven in a recess in the crossbar so that a very direct and precise flow of gas/air from the nozzles can be obtained, and the web material can be cut while in contact with the crossbar. When comparing this embodiment, where the web is supported during cutting, with the prior art, where the web is cut, when unsupported, a more clean and unproblematic cutting process is achieved, and thus, there is less risk of something going wrong during changing of core.

In another embodiment of a winding apparatus according to the invention, the cutting means comprises a knife unit that is installed in and driven along a stationary crossbar, e.g., a crossbar with nozzles. By installing the cutting means directly into the crossbar, a simple and robust solution is obtained since the movable parts and the gas/air ejecting parts are all integrated into a single unit.

In another preferred embodiment of the invention, air at a first lower pressure is expelled from the cross bar prior to and during cutting of the web. As a result, the web material is lifted slightly from the cross bar, which results in the cutting of the web being performed easier and the risk of tearing the web, e.g., due to forces acting on the web material, e.g., from the rollers, is reduced.

In yet another embodiment, air at a second higher pressure is expelled from the cross bar immediately after cutting of the web, which results in the free end of the web will be blown towards the empty core.

An embodiment of the invention will now be described, by way of example only, with reference to the accompanying drawings.

DETAILED DESCRIPTION OF THE INVENTION

In the following text, the figures will be described one by one and the different parts and positions seen in the figures will be numbered with the same numbers in the different figures. Not all parts and positions indicated in a specific figure will necessarily be discussed together with that figure.

The FIGS. 1 to 9 all show more or less the same details, but in different stages or positions during winding, replacing the core 1 and cutting the web material 2.

Figure 1:
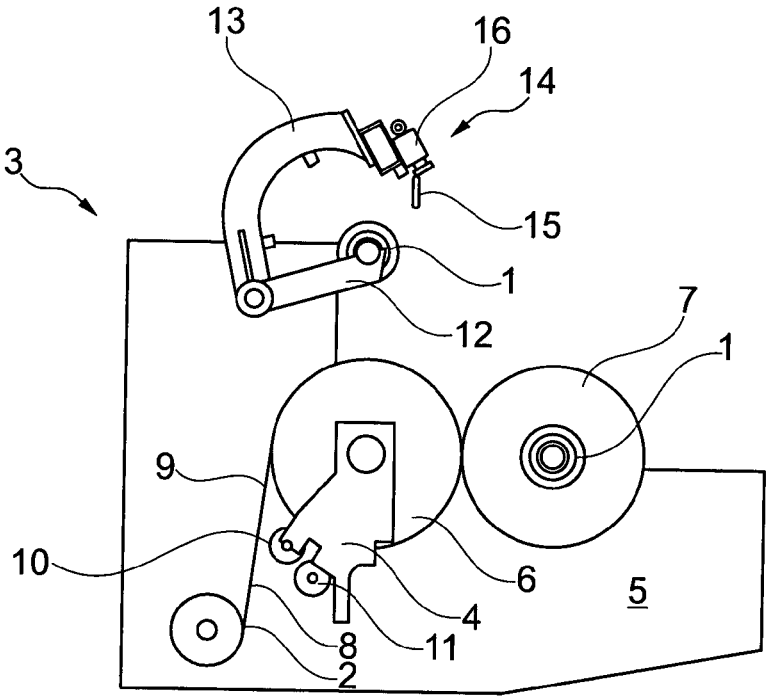
FIG. 1 shows a winding apparatus during winding of a web and with the retainer arms in a 6 o'clock position.

In FIG. 1, a winding apparatus 3 is shown during winding of a web 2 and with the retainer arms 4 in a 6 o'clock position. The various parts are mounted on a chassis 5 and comprise a winding drum 6 over which the web 2 is guided onto a roll 7 of web material 2 with the first side 8 of the web 2 towards the winding drum 6 and the second side 9 of the web 2 opposite to the first side 8. The roll 7 is rotated due to traction between said second side 9 of the web 2 and the winding drum 6 which is driven by a motor (not shown). On the retainer arm 4, a roller 10 and a crossbar/air bar 11 are shown which will be described in more detail later. Above the winding drum 6 and attached to the chassis 5, there is a carrier arm 12 that carries an empty core 1 onto which the web 2 will be wound after the roll 7 is completed. The carrier arms 12 are connected to a pivot arm 13 that comprises a knife unit 14 having cutting means 15 as well as an actuator 16 for performing a transverse movement of the cutting means 15 in relation to the web 2, the roller 10 and the cross bar 11. The actuator 16 preferably can be a pneumatic linear actuator that works at high speed.

Figure 2:
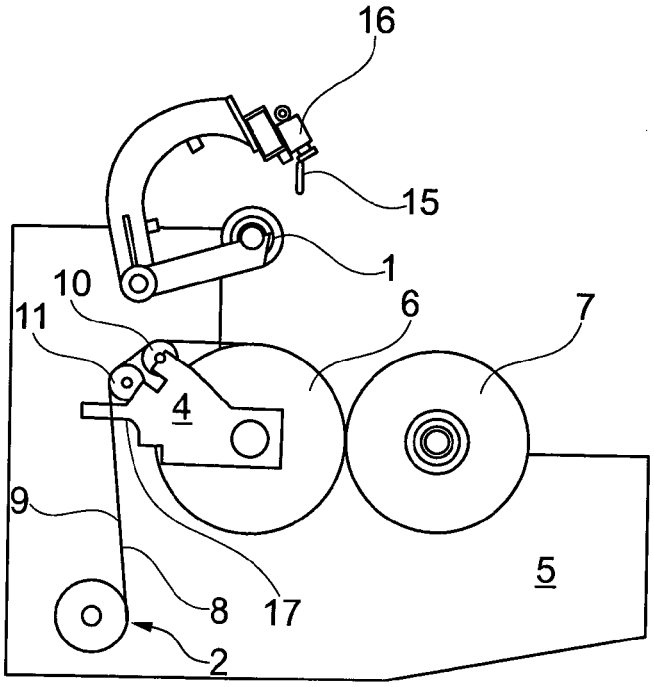
FIG. 2 shows a winding apparatus during winding of a web and with the retainer arms in a 9 o'clock position and preparing for a change of core/roll.

In FIG. 2, the retainer arms 4 are in a 9 o'clock position as they are rotated around the center axis of the winding drum 6 in order to prepare for a change of core 1 for a producing new roll 7 of web 2. As it can be seen, the web 2 is lifted from the surface of the winding drum 6, and thus, carried or guided on the roller 10 and the crossbar 11. The roller 10 will typically, and as indicated by its name, be rotatable, and the crossbar 11 will comprise a number of nozzles or openings for a flow of gas/air.

Figure 3:
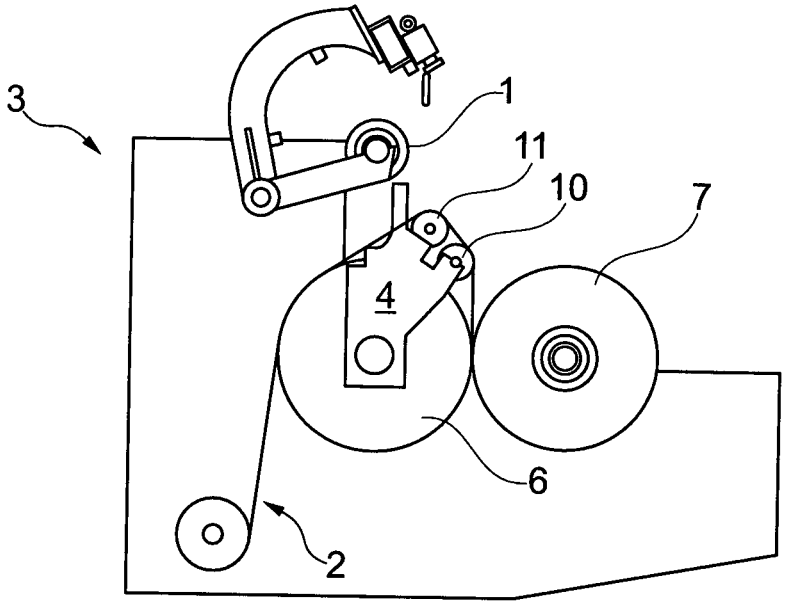
FIG. 3 shows a winding apparatus during winding of a web and with the retainer arms in a 12 o'clock position and preparing for a change of core/roll.

FIG. 3 shows a winding apparatus 3 during winding of a web 2 and with the retainer arms 4 in a 12 o'clock position in preparation for a change of core 1 and roll 7. As can be seen in the figure, the web 2 is lifted from the surface of the winding drum 6.

Figure 4:
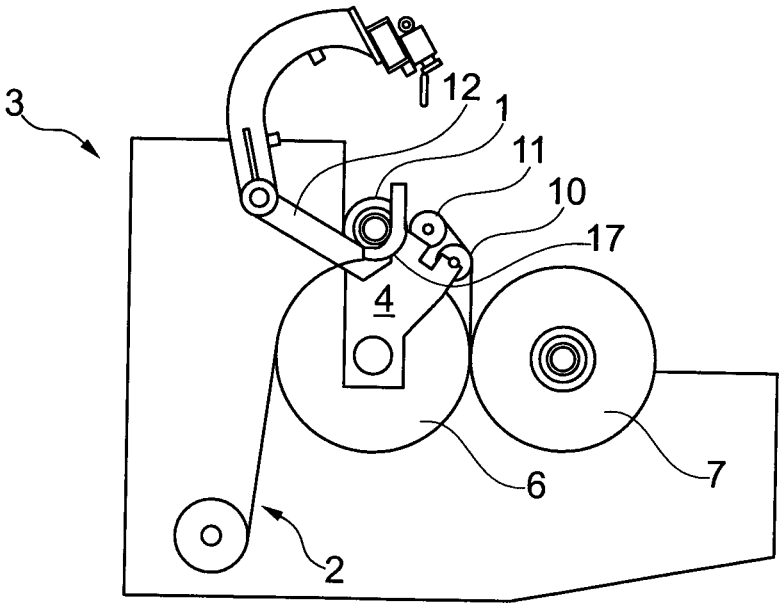
FIG. 4 shows a winding apparatus during winding of a web and with the retainer arms in a 12 o'clock position with an empty core in position.

In FIG. 4, the retainer arms 4 are in a 12 o'clock position and with the carrier arm 12 in a lowered position placing an empty core 4 in position in a recess 17. At this stage, the empty core 1 is in contact with the moving web 2.

Figure 5:
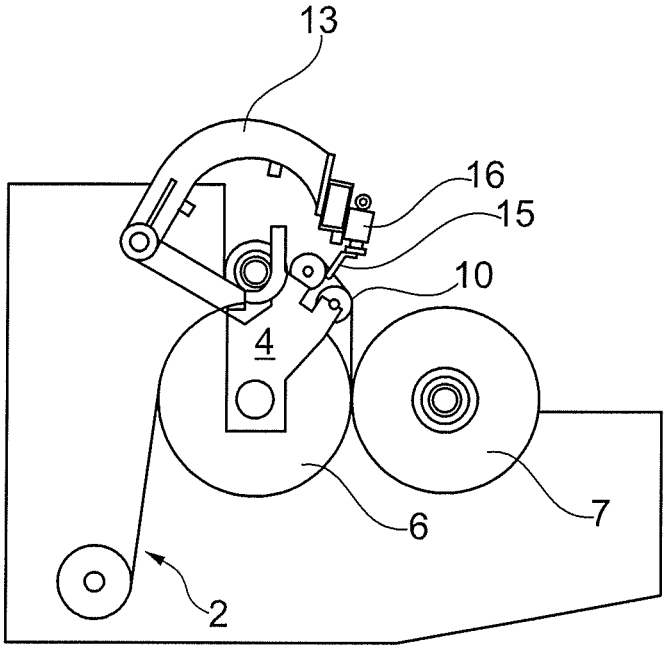
FIG. 5 shows a winding apparatus during winding of a web and with the retainer arms in a 12 o'clock position with the knife unit in position and ready to cut.

FIG. 5 still shows the retainer arms 4 in a 12 o'clock position but now with lowered pivot arms, and thus, with the knife unit 14 comprising cutting means 15 and an actuator 16 in position to perform a crosswise cut of the web 2.

Figure 6:
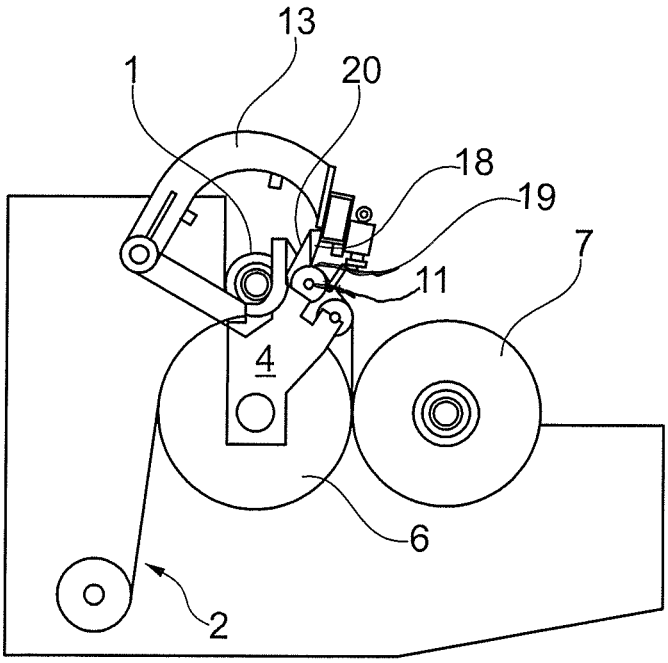
FIG. 6 shows a winding apparatus during winding of a web and with the retainer arms in a 12 o'clock position just after cutting the web.

FIG. 6 shows the next step just after cutting the web material 2, with the retainer arms 4 still in a 12 o'clock position, but now also showing the free end 20 of the web material 2 that is created by the cutting process. Further, air 18 (illustrated by cones) is ejected through nozzles 19 in the crossbar 11. As the expelled air 18 will force the free end 20 of the web 2 away from the crossbar 11, the web 2 will be blown towards the empty core 1, and thus, a new roll 7 will be started.

Figure 7:
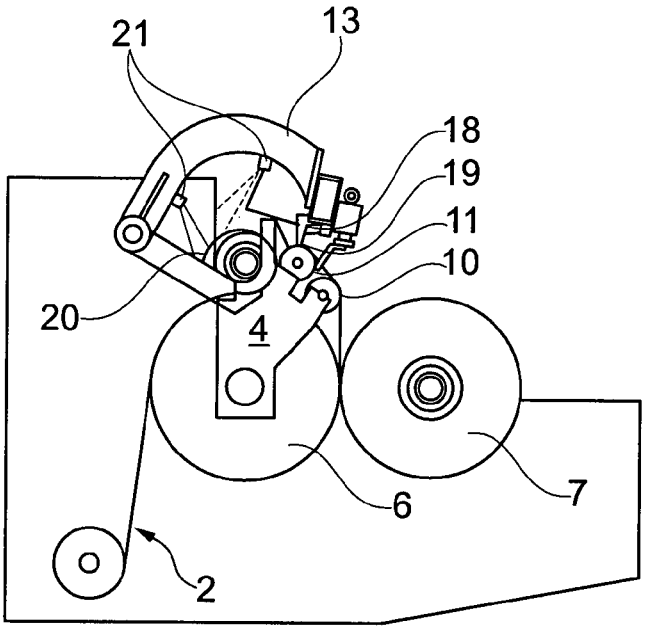
FIG. 7 shows a winding apparatus during winding of a web and with the retainer arms in a 12 o'clock position with the nozzles blowing air to guide the web.

In FIG. 7, the retainer arms 4 are still in a 12 o'clock position, but here air is blown/ejected from the nozzles 19 in the crossbar 11 as well as from additional nozzle means 21 arranged on the pivot arms 13. With all the nozzles 19, 21 blowing/ejecting air to guide the web 2 towards the core 1, a very precise winding will take place with almost no wrinkling, or even with no wrinkling of the innermost layers of the web 2. Meanwhile, the roll 7 is ejected from the winding apparatus.

Figure 8:
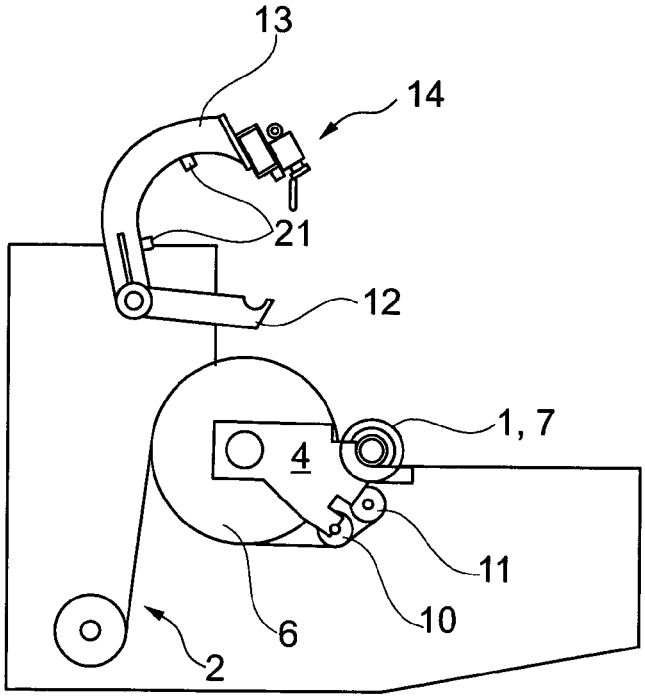
FIG. 8 shows a winding apparatus during winding of a web and with the retainer arms in a 3 o'clock position while placing the new core/roll.

FIG. 8 shows the winding apparatus 3 during winding of a web 2 onto the new core 1 and with the retainer arms 4 in a 3 o'clock position while placing the core 1/roll 7 next to the winding drum 6. Here, the carrier arm 12 and the pivot arm 13 are retracted into the starting position and ready for receiving a new empty core 1 for the next change of roll 7.

Figure 9:
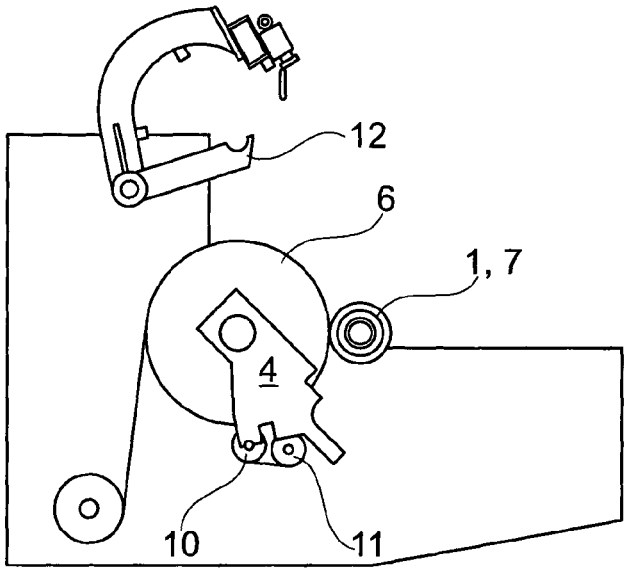
FIG. 9 shows a winding apparatus during winding of a web and with the retainer arms in a 5 o'clock position and with the new core/roll in place for winding.

Finally, FIG. 9 shows the winding apparatus 3 during winding of web 2 and with the retainer arms 4 in a 5 o'clock position and with the new core 1/roll 7 in place for winding. From this position, the retainer arms 4 are moved to the 6 o'clock position shown in FIG. 1 and the winding apparatus is now ready for receiving a new empty core 1 at the carrier arm prior to the next change of roll 7.

Figure 10:
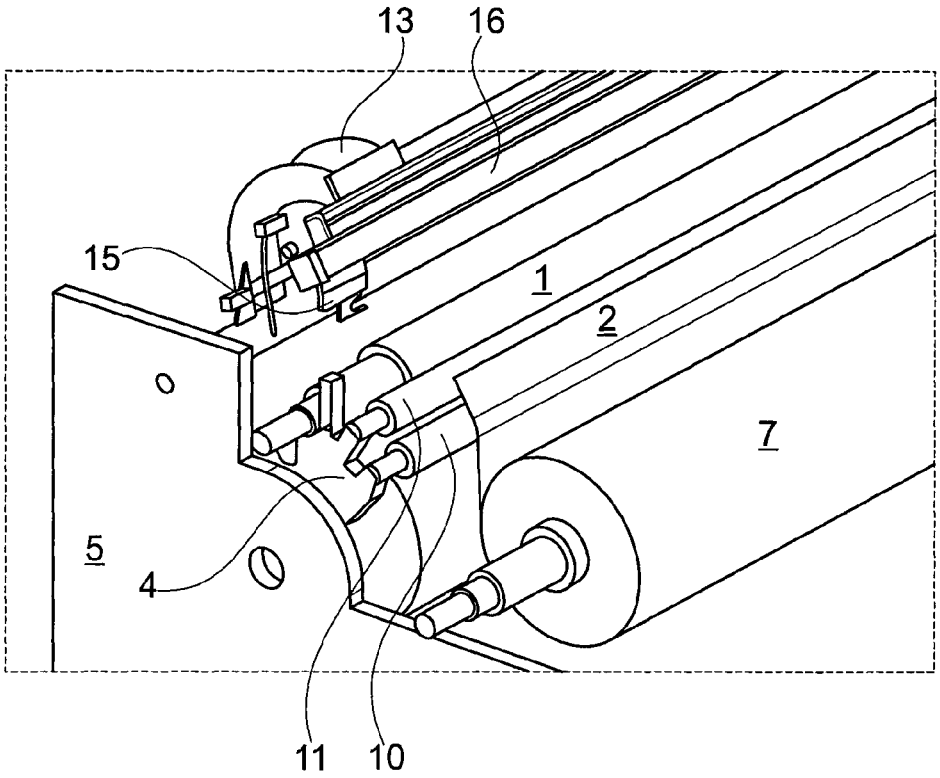
FIG. 10 is a perspective view of an end of the winding apparatus.

In FIG. 10, one end of the winding apparatus 3 is seen in perspective, and the position of the various parts corresponds to what is shown in FIG. 4.

Figure 11:
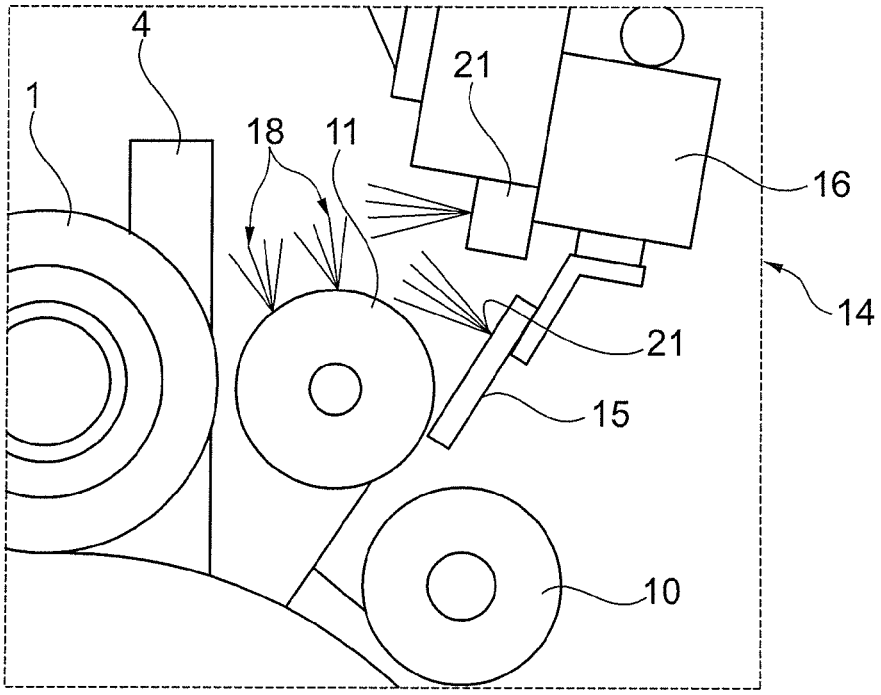
FIG. 11 shows a knife unit with nozzle means.

FIG. 11 shows a knife unit 14 with nozzle means 21 installed next to the actuator 16. These nozzle means 21 can be stationary, but can also be moved together with the cutting means 15 as the cutting means are moved across the web 2. There can also be nozzle means 21 integrated in the cutting means 15, in order to expel gas/air right next to the cutting and towards the web material 2 as indicated by flow lines in FIG. 11, i.e., the nozzles 21 will expel air directing the free end 20 of the web 2 towards the new core 1.

Figure 12:
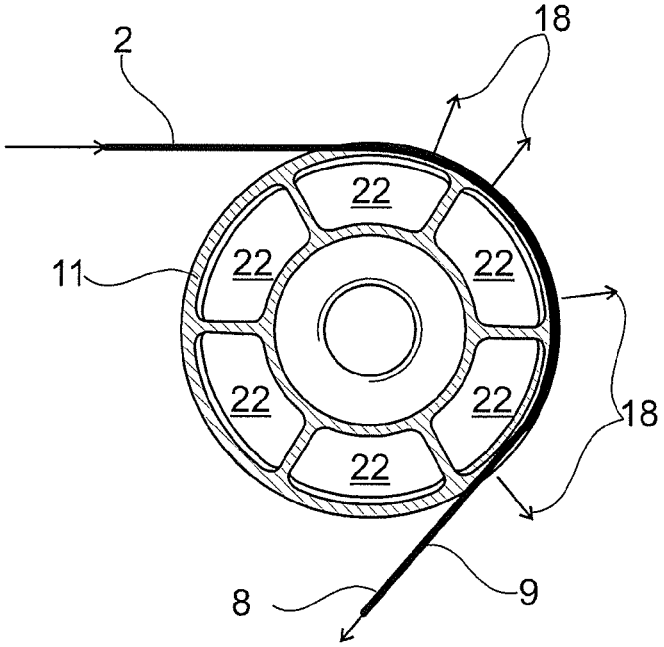
FIG. 12 shows a cross section of a crossbar/air bar with internal compartments.

FIG. 12 shows a cross section of a crossbar/air bar 11 with internal compartments 22. The internal compartments 22 are used as channels for a compressed gas, which typically will be atmospheric air compressed to one or more levels and guided in the internal compartments 22 to nozzles 19 in the surface of the crossbar 11. By using a different level of pressure in one or more compartments 22, the web can be guided even more directly in specific cases. One of the compartments 22 can e.g., be open towards the first side 8 of the web 2 and thus forms a recess into which the cutting means 15 can be inserted and operated along/in the cross bar 11, and to cut the web 2 while it is supported on both sides of the cut.

In a preferred embodiment of the invention, the air bar 11 expels air at a first lower pressure, prior to cutting of the web. As a result, the web material is lifted slightly from the air bar 11, so that cutting of the web is performed easier and the risk of tearing the web, e.g., due to forces acting on the web material, e.g., from the rollers, is reduced. The pressure necessary for lifting the web will be slightly above the surrounding pressure, and may, e.g., be up to 1-3 bars or preferably up to 1-2 bars above the surrounding pressure. The actual value of the pressure depends on the web material, such as its density and/or thickness, whether the web is sticky or not and/or whether a single or multiple webs are rolled onto the empty core 1. Thus, the lower pressure may also be above or below the above mentioned values, if the nature of the web so requires. The air flow at the lower air pressure is applied for a period of time, i.e., the period when the air bar is in contact with the web prior to cutting. Then, an air blast at a second, higher pressure is expelled from the air bar 11 during or immediately after cutting of the web material 2 so that the free end 20 of the web 2 will be blown towards the empty core 1 as described in detail above by the air blast expelled from the air bar 11. The pressure blast necessary to blow the free end 20 of the web 2 towards the empty core 1 will be significantly higher than the lower pressure, e.g., 1-25 bars, such as 5-15 bars. The actual value of the air pressure applied during the air blast also depends on the web material, such as density and/or thickness of the web, whether the web is sticky or not and/or whether a single or multiple webs are rolled onto the empty core 1. Thus, the air blast pressure may also be above or below the above mentioned values, if the nature of the web requires so. The air blast is applied for a very short period only, e.g., up to 1-2 seconds or preferably shorter.

In addition, the present invention provides means for retrofitting existing winding apparatus to adapt to the present invention, in particular to existing winding apparatus, which cuts the web from the exterior side, i.e., the second side of the web 2. When retrofitting such an existing winding apparatus, a cross bar 11 as described above can be installed in a way similarly to the present invention. It is only required, that the winding apparatus comprises an index arm 4 and a winding drum 6 mounted in a winding apparatus, in a way, which is similar to the present invention, and preferably as illustrated in FIG. 1.

The invention is not limited to the embodiments described herein, and may be modified or adapted without departing from the scope of the present invention as described in the patent claims below.

What is claimed is:

1. A winding apparatus configured for winding a web material, comprising a first and a second side and a free end onto an empty core and into a roll, said winding apparatus comprising a winding drum for guiding said web material by supporting said web material on the first side, and further comprising cutting means for cross cutting said web material prior to said web material being wound onto an empty core, said winding apparatus further comprises means for moving said empty core from a first position to a second position, said means comprising a set of retainer arms for carrying and moving said core from said first position to said second position near the periphery of said winding drum while web material is being wound onto said core, and for carrying at least one roller, said roller being arranged to lift said web material from said winding drum, during winding, prior to cross cutting said web material along said roller and thus creating said free end of web material, wherein said winding apparatus further comprises nozzle means for ejecting a gas onto the first side of said web material near said free end of said web material, wherein said nozzle means comprise a cross bar extending substantially in parallel with said winding drum, said cross bar comprising a number of nozzles which are distributed across the entire length of the cross bar, said nozzles being directed towards the first side of said web material, and wherein said cross bar is hollow and comprises at least two internal compartments for said gas, said compartments extending along the length of said cross bar and communicating with respective ones of said nozzles.

2. The winding apparatus according to claim 1, wherein said winding apparatus comprises further nozzle means, said further nozzle means also being directed towards the first side of said web material and arranged along the winding drum.

3. The winding apparatus according to claim 1, wherein said cutting means comprise a knife unit, said knife unit further comprising nozzle means for ejecting gas towards the first side of the web material while cutting said web material.

4. The winding apparatus according to claim 1, wherein said cutting means comprise a mechanism that allows said knife unit to be moved along the winding drum while in contact with said web material, said mechanism comprising means for moving said cutting means across said web material.

5. The winding apparatus according to claim 1, wherein said cutting means comprise a knife unit, and further comprise a stationary cross bar, said cross bar having a recess in the longitudinal direction, where at least a part of said knife unit is moved in said recess.

6. The winding apparatus according to claim 1, wherein said cutting means comprise a knife unit, said knife unit being installed in and driven along a stationary cross bar.

7. The winding apparatus according to claim 1, wherein air at a first lower pressure is expelled from the cross bar prior to cutting of the web.

8. The winding apparatus according to claim 7, wherein an air blast at a second higher pressure is expelled from the cross bar during or immediately after cutting of the web.

* * * * *